United States Patent [19]

Junek et al.

[11] 3,968,636

[45] July 13, 1976

[54] OPEN-END FIBER SPINNING MACHINE

[75] Inventors: Jan Junek, Usti nad Orlici; Vaclav Vobornik, Lethohrad; Frantisek Jaros, Usti nad Orlici; Josef Ripka, Usti nad Orlici; Ludmila Lihtarova, Usti nad Orlici; Vladimir Ohlidal, Usti nad Orlici; Frantisek Hortlik, Usti nad Orlici, all of Czechoslovakia

[73] Assignee: Vyzkumny Ustav Bavlnarsky, Usti nad Orlici, Czechoslovakia

[22] Filed: Oct. 22, 1974

[21] Appl. No.: 516,908

[30] Foreign Application Priority Data

Oct. 24, 1973 Czechoslovakia ..... 7309-73

[52] U.S. Cl. ..... 57/58.95

[51] Int. Cl.[2] ..... D01H 1/12

[58] Field of Search ..... 57/58.89, 58.95

[56] References Cited

UNITED STATES PATENTS

| | | | |
|---|---|---|---|
| 3,584,451 | 6/1971 | Chrtek | 57/58.95 |
| 3,777,466 | 12/1973 | Kabele et al. | 57/58.89 |
| 3,826,071 | 7/1974 | Grau | 57/58.95 X |

*Primary Examiner*—Richard C. Queisser
*Assistant Examiner*—Charles Gorenstein

[57] ABSTRACT

Open-end fiber spinning machine including an under pressure spinning chamber and an opening roller mounted in a fiber opening body. The opening roller engages a feeding channel for feeding the separated fibers, said channel connecting directly the inner space of the spinning chamber with an environment of higher pressure. The feeding channel is provided in a wall located oppositely to the fiber opening roller with a curved surface which is engaged by the circumferential circle line of the sawtooth covering of the fiber opening roller.

3 Claims, 3 Drawing Figures

OPEN-END FIBER SPINNING MACHINE

The present invention relates to a device for spinning fibers in open-end spinning machine comprising an under pressure spinning chamber and an opening roller mounted inside a fiber opening mechanism body; said roller engaging a feeding channel for feeding separated fibers, which connect the inner space of the spinning chamber directly with the ambient atmosphere.

Several types of known fibers opening devices are used for open-end spinning in rotary chambers. The present invention is related to a known fiber opening device comprising, on one hand, a massive opening roller provided about its cylindrical circumference with a sawtooth covering, and, on the other hand, a feeding roller with a pressing block, said opening roller engaging the feeding channel. In this known system, the separated fibers are doffed from the sawtooth covering of the opening roller into the feeding channel by centrifugal force.

One of the disadvantages of this system consists in that a sawtooth covering with a smaller angle of the tooth blade cannot be used, as in this case fibers are caught up by the teeth and, consequently, a yarn of lower quality is obtained. However, there is known a substantial improvement of this system, as described in Czechoslovakian Pat. No. 125, 190, in which air is fed to the fiber doffing area inside the feeding channel from an area of higher pressure, e.g. the ambient atmosphere. Thus the fibers are doffed, beside the centrifugal forces, also by the difference in pressure brought about by the proportion of speeds of the opening roller and the air fed thereto, which acts upon the separated fibers in a radial direction from the opening roller.

In that method, a sawtooth covering with a relatively small tooth blade angle may be used; however, it is necessary considerably to increase the velocity of the air in the feeding channel, since the force acts upon the fiber over a very short section. In that embodiment the feeding channel is so made, for purposes of production technology in such an advantageous embodiment, that the inner space of the spinning chamber is connected with the ambient atmosphere by a direct feeding channel. The opening roller partially engages said feeding channel, and at one point there is a minimum cross sectional area of flow between the cylindrical surfaces of the opening roller and the opposite wall of the feeding channel. Exactly at this cross sectional area of flow, the fiber is acted upon by the maximum force, which is given by the velocity of the air. Upon increasing the production of the machine, it is necessary to separate and thus also to doff a rather great quantity of fibers in a given time interval. In order to bring about a correct fiber doffing, it is necessary also to increase the velocity of air in this minimum cross section of the feeding channel. An increased velocity of air in the feeding channel, however, has, as a consequence, the disadvantage of increasing energy losses.

The problem with that system of doffing fibers consists in securing a perfect doffing upon reducing energy losses to a minimum.

This problem is solved by the device, according to the present invention, in which the feeding channel is provided in its wall, located oppositely to the opening roller, with a chamber or a round surface which is engaged by the circumferential circle line of the sawtooth lining of the opening roller. The chamber advantageously has the shape of a partly cylindrical recess. According to an advantageous embodiment of the present invention, the chamber has a depth H equal to 0.5 to 5 mm.

An embodiment of the device, according to the present invention, is described in the form of an example in the specification and shown in the accompanying drawings, in which.

Figure 1:
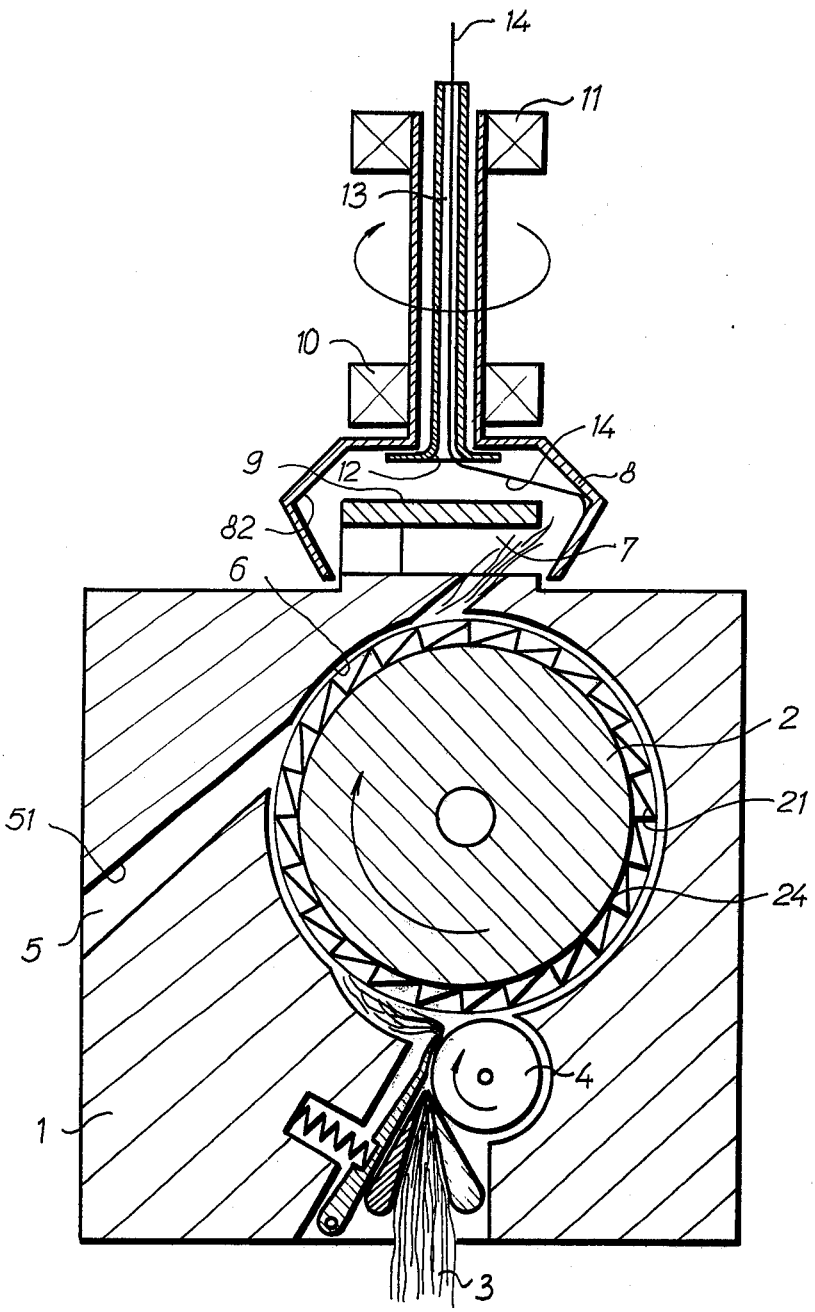
FIG. 1 is a view in section through a diagrammatically shown spinning unit.
Figure 2:
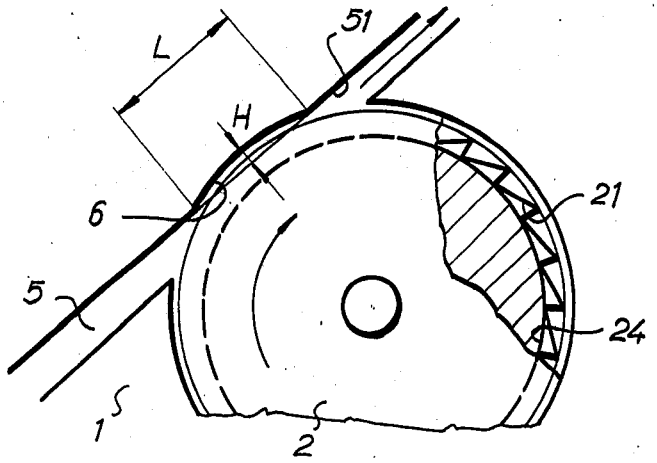
FIG. 2 is a detailed sectional view of the apparatus at the point of doffing, at which the opening roller engages the chamber in the oppositely located wall of the feeding channel.

The illustrated spinning unit has a fiber opening device body 1, in which is rotatably mounted a fiber opening roller 2, on the cylindrical surface of which there is fastened a sawtooth lining 21. In the lower part of body 1, there is mounted a feeding roller for feeding a sliver 3 of fibrous material. Further, a feeding channel 5 is arranged inside body 1, for connecting in a straight direction the inner space 7 of spinning chamber 8 with the ambient atmosphere. Spinning chamber 8 is rotatably mounted in bearings 10 and 11 and is driven in a known manner from a continuous belt (not shown). In the hollow shaft of spinning chamber 8, there is mounted a withdrawing tube 12 which is provided with an opening 13 for withdrawing yarn 14 from the collecting surface 82 of the spinning chamber 8 by means of known and not shown withdrawing and winding elements.

The feeding channel 5 merges into spinning chamber 8 below the separator 9 which is fastened to fiber opening device body 1, which also forms a lid for covering the front of the spinning chamber and for a further, not shown, body of the spinning chamber 8. In the wall 51 of feeding channel 5, opposite to the fiber opening roller 2, a chamber 6 is provided, which has advantageously the shape of a part-cylindrical recess. The chamber 6 is engaged by the circumferential circle line of the sawtooth covering 21. The chamber 6 has advantageously a depth $H = 0.5$ to 5 mm.

The device, according to the present invention, operates as follows:

A sliver 3 of fibrous material is fed to the sawtooth lining 21 of opening roller 2 by means of feeding roller 4. The opening roller 2 with its sawtooth covering 21 opens the fibers and feeds them into feeding channel 5, in which they are doffed and fed to the spinning chamber 8. Inside chamber 8, the fibers are deposited on the so-called collecting surface 82 in the form of a ribbon, which is wrapped in a known manner to form yarn 14, which is, in turn, withdrawn through opening 13 of withdrawing tube 12 and wound onto a, not shown, bobbin. The doffing of the fibers from the sawtooth covering 21 of opening roller 2 is performed, on one hand, by centrifugal force, and, on the other hand, by the pressure gradient caused by faster air flow fed into spinning chamber 8 through feeding channel 5. The air in the feeding channel 5 flows in a quantity of 1.5 to 3 liters per second, and thus the mean air speed in the minimum section of channel 5, which is defined by chamber 6 and the bottom cylindrical surface 24 of opening roller 2, is higher than the circumferential speed of the opening roller 2. The minimum section of feeding channel 5 is extended by chamber 6 in the form of a cylindrical recess to a length L, and thus an extension of the aerodynamic action of air upon the fibers in the direction of their movement is achieved. Thereupon, effective doffing of all fibers in the covering of the opening roller is attained, and thus also a sticking thereof and the necessity of cleaning is eliminated.

Figure 3:
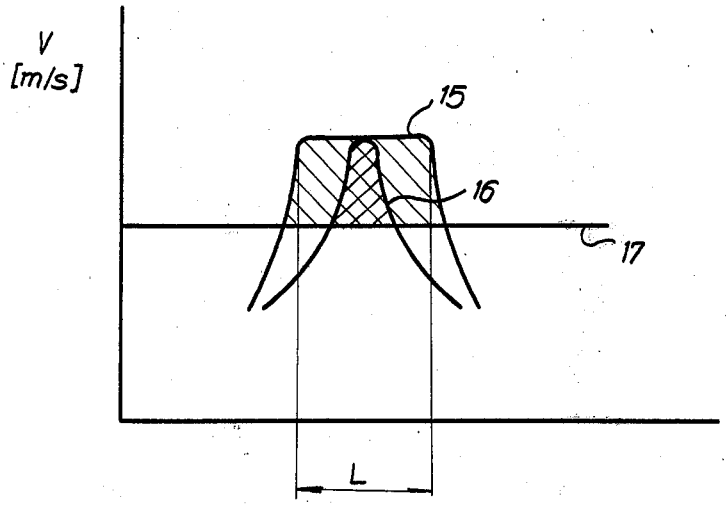
FIG. 3 is a graph of the course of mean air speed, according to the present invention, in comparison with the device according to the Czechoslovakian Pat. No. 125,190.

The difference of the aerodynamic action of air upon fibers in the device, according to the present invention, and the device according to the Czechoslovakian Pat. No. 125,190 is shown in FIG. 3, in which the course of the mean air speed along feeding channel 5 in the device, according to the present invention, is represented by line 15, whereas in the device according to the Czechoslovakian Pat. No. 125,190, by line 16. The circumferential speed of fiber opening roller 2 is represented by line 17. The surface defined by lines 15 and 17 is proportional to the force action of air in the device, according to the present invention, and the surface between lines 16 and 17 is proportional to the force action of air in the device, according to the Czechoslovakian Pat. No. 125,190. It is obvious, that the same force action in the device of the present invention is achieved with a smaller quantity of air per second, and also causes a bigger force action upon the fibers, i.e., a more perfect doffing of fibers from the covering 21 of the opening roller 2. Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In an open-end fiber spinning machine including an under pressure spinning chamber and an opening roller having a sawtooth covering mounted in a fiber opening body, said opening roller engaging a feeding channel for feeding the separated fibers, said channel connecting directly the inner space of the spinning chamber with an environment of higher pressure, the improvement wherein the feeding channel is provided in the wall thereof located opposite the fiber opening roller with a recess which is engaged by the sawtooth covering of the fiber opening roller, said covering being adapted to sweep adjacent the wall of said recess.

2. Spinning machine as claimed in claim 1, wherein the recess has the shape of a partly cylindrical recess.

3. Spinning machine as claimed in claim 2, wherein the recess has a depth $H = 0.5$ to 5 mm.

* * * * *